US006077317A

United States Patent [19]

Murphy

[11] Patent Number: 6,077,317

[45] **Date of Patent: *Jun. 20, 2000**

[54] PREWASH STAIN REMOVER COMPOSITION WITH SILOXANE BASED SURFACTANT

[75] Inventor: Dennis Stephen Murphy, Leonia, N.J.

[73] Assignee: Lever Brothers Company, Division of Conopco, Inc., New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/591,788

[22] Filed: Jan. 25, 1996

[51] Int. Cl.[7] ..... C11D 3/386; C11D 3/04; B08B 1/00

[52] U.S. Cl. ..... 8/137; 510/277; 510/283; 510/284; 510/285; 510/413; 510/422; 510/466; 134/42; 435/263

[58] Field of Search ..... 510/277, 283, 510/284, 413, 422, 466; 8/137; 134/42; 435/263, 264

[56] References Cited

U.S. PATENT DOCUMENTS

| | | | |
|---|---|---|---|
| 3,299,112 | 1/1967 | Snyder | 260/448.2 |
| 3,462,369 | 8/1969 | Mankowich | 252/135 |
| 4,075,188 | 2/1978 | Gault et al. | 252/135 |
| 4,260,528 | 4/1981 | Fox et al. | 510/223 |
| 4,465,619 | 8/1984 | Boskamp | 510/405 |
| 4,472,297 | 9/1984 | Bolich, Jr. et al. | 510/121 |
| 4,491,539 | 1/1985 | Hoskins et al. | 510/426 |
| 4,543,205 | 9/1985 | Contamin | 510/136 |
| 4,556,510 | 12/1985 | Holsopple | 510/159 |
| 4,576,744 | 3/1986 | Edwards et al. | 510/426 |
| 4,595,527 | 6/1986 | Gipp | 510/284 |
| 4,617,148 | 10/1986 | Shields | 510/138 |
| 4,678,606 | 7/1987 | Akhter et al. | 510/159 |
| 4,711,739 | 12/1987 | Kandathil | 510/284 |
| 4,786,439 | 11/1988 | Ploog et al. | 252/8.63 |
| 4,788,006 | 11/1988 | Bolich, Jr. et al. | 510/121 |
| 4,842,762 | 6/1989 | Sabol, Jr. et al. | 510/284 |
| 4,877,546 | 10/1989 | Lai | 510/428 |
| 4,909,962 | 3/1990 | Clark | 510/284 |
| 4,927,563 | 5/1990 | McCall | 424/702 |
| 4,954,286 | 9/1990 | Sepulueda et al. | 510/284 |
| 5,112,358 | 5/1992 | Deal, III | 8/137 |
| 5,126,066 | 6/1992 | Torenbeek et al. | 252/186.26 |
| 5,186,856 | 2/1993 | Holland | 510/284 |
| 5,190,693 | 3/1993 | Mattioli et al. | 252/313.1 |
| 5,221,496 | 6/1993 | Holland | 510/284 |
| 5,232,632 | 8/1993 | Woo et al. | 510/406 |
| 5,254,284 | 10/1993 | Barone et al. | 510/181 |
| 5,286,405 | 2/1994 | Rennie et al. | 510/397 |
| 5,336,430 | 8/1994 | Bahary et al. | 510/222 |
| 5,366,654 | 11/1994 | Van Den Brom et al. | 134/25.2 |
| 5,419,848 | 5/1995 | VanEenam | 510/365 |
| 5,536,436 | 7/1996 | Pramod | 510/321 |
| 5,538,662 | 7/1996 | Klier | 510/284 |

FOREIGN PATENT DOCUMENTS 0 544 493 A1 of 0000 European Pat. Off. .

OTHER PUBLICATIONS

National Starch & Chemical Speciality Polymers Division, "Novel applications for water–soluble, hydrophobically–modified polymers in fabric wash detergents," Hodgetts et al. (No Date.

National Starch & Chemical Limited Speciality Polymers, "Speciality Polymers NARLEX H1200" Jun. 20, 1995.

"Speciality Polymers Narlex H1200" National Starch & Chemical Limited Speciality Polymers Jun. 20, 1995.

*Primary Examiner*—Kery Fries

[57] ABSTRACT

Pretreater stain remover composition and method of using it is described. The composition comprises a siloxane based surfactant combined with a cosurfactant. Optionally, an antiredeposition polymer, enzymes and enzyme stabilizing system are added to effectively remove both oil and water based stains from a variety of fabrics.

12 Claims, No Drawings

PREWASH STAIN REMOVER COMPOSITION WITH SILOXANE BASED SURFACTANT

FIELD OF THE INVENTION

This invention relates to a soil and stain remover with a wetting agent for enhanced stain removal of oil and water based stains on a variety of fabrics.

BACKGROUND OF THE INVENTION

Prewash stain remover compositions for the laundry have been in use for many years. These compositions are available in liquid, spray and semi-solid stick form. The consumer applies the stain remover to the soiled portions of the garments before washing with a laundry detergent.

While pretreaters have been shown to improve cleaning of soiled areas before the use of the laundry detergent, such stain removers have not proven equally effective in all forms and for all types of stains and fabrics.

Solvent based compositions were formulated to remove difficult grease or oil stains from fabric surfaces from lipophilic fabric surfaces such as polyester and blends of polyester blends. Aqueous based formulations were developed to remove water based stains including those stains which are sensitive to oxidation and enzymes (see U.S. Pat. No. 4,842,762).

Formulators have recently moved away from solvent based formulations to provide more environmentally, friendly products (see U.S. Pat. No. 4,595,527 S. C. Johnson). Cleaning can be compromised in solvent free systems, thus aqueous based formulations based on nonionic surfactants were developed. The cleaning performance of such pretreaters was improved by incorporating builders or chelants in the formula (see U.S. Pat. No. 4,595,527). However, many of these chelants caused the formulations to separate and enzymes or actives were not specifically directed to the soiled areas.

U.S. Pat. No. 5,186,856 (BASF) describes a solvent free pretreater based on a chelating agent which does not exhibit separation.

However, there still exists a need in the art for a stable aqueous pretreater based on non-ionic surfactants which can be directed to penetrate both oil and water based stains for improved cleaning performance.

It is therefore an object of the present invention to provide an aqueous laundry stain pretreater composition which provides outstanding cleaning performance on both oil and water based stains on a variety of fabrics.

Another object of the present invention is to provide a pretreater composition which is based on nonionic surfactants and which incorporates a silicone wetting agent to penetrate stained areas of fabrics for improved cleaning performance.

Another object of the invention is to provide an aqueous nonionic based pretreater composition which is shelf stable and which is free of chelating agents yet does not compromise cleaning performance.

SUMMARY OF THE INVENTION

The compositions of the invention achieve these and other objects of the invention and contain from about 0.1 to about 10% of a siloxane based surfactant and from about 0.1 to about 50% of a cosurfactant selected from the group consisting of a nonionic, an anionic, a cationic, a zwitteronic and mixtures thereof. The compositions optionally contain an antiredeposition polymer, preferably a polycarboxylate used in an amount of about 0.1 to about 5%.

Enzymes and an enzyme stabilizing system are optionally incorporated into the composition for improved cleaning.

The compositions of the invention provide improved penetration of the soiled areas to enhance stain removal by the pretreater composition prior to the laundry wash. The formulation may also be incorporated into a heavy duty liquid detergent to enhance stain removal during the washing cycle.

DETAILED DESCRIPTION OF PREFERRED EMBODIMENTS

Siloxane Based Surfactant

A siloxane based surfactant is incorporated in the compositions as a wetting agent to provide improved penetration of the composition into the stained area. The trisiloxane based surfactant has the following formula I:

(I)

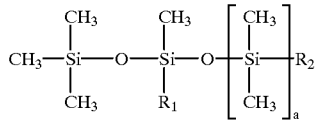

wherein $R_1$ and $R_2$ are each independently an alkyl having 1–3 carbons or $—C_nH_{2n}O[C_2H_4O]_y[C_3H_6O]_z—Q$ provided $R_1$ and $R_2$ are not the same, a is 0–2, n has a value from 2 to 4; y has a value of 3 to 10; z has a value from 0 to 5; Q is selected from the group consisting of hydrogen and a branched or straight chain alkyl having 1 to 4 carbon atoms. Preferably a is 0 to 1, n is 2 to 4, y is 5 to 9, z is 0 to 3 and Q is a 1 to 3 straight alkyl.

Preferred siloxane compounds are polyalkylene oxide modified 1, 1, 1, 3, 5, 5, 5-heptamethyl trisiloxane, polyalkylene oxide modified 1,1,3,3,5,5,5-hepta methyl trisiloxane, and polyalklyene oxide modified 1, 1, 3, 3, 3 pentamethyl disiloxane.

The superspreading, siloxane surfactants described by Formula I above can be prepared using procedures well known to those skilled in the art. In general, the superspreading, siloxane surfactant is obtained by hydrosilylation of an alkenyl ether (e.g., vinyl, allyl, or methallyl) onto the unmodified methylsiloxane in accordance with procedures described by W. Noll in The Chemistry and Technology of Silicones, Academic Press (New York: 1968). The superspreading, low-foaming siloxane of Formula I in which Q is hydrogen is formed by reacting an uncapped alkenyl polyether with the unmodified methylsiloxane in the presence of chloroplatinic acid at temperatures ranging from about 80° C. to 100° C. The siloxane of Formula I in which Q is an alkyl group having 1 to 3 carbon atoms is prepared by the reaction of an uncapped alkenyl polyether and sodium methoxide in the presence of a solvent such as toluene with heating to form the sodium salt of an allyl polyether. The salt of the allyl polyether is reacted with a 1-alkyl ($C_1$ to $C_3$) halide to form a capped alkenyl polyether which is hydrosilated with hydrosiloxane as set forth above. Siloxane surfactants are disclosed, for example, in U.S. Pat. Nos. 3,299,112 and 4,933,002 and are available, for examples, as Silwet L-77® (OSi Specialties Inc., Danbury, Conn.) and Sylgard® 309 (Dow Corning), respectively.

The compounds of formula I should be present in the compositions in an amount of 0.1 to about 5 wt. %, preferably 0.5 to about 3 wt. %, most preferably 0.5 to 2 wt. %.

It was surprisingly discovered that when the siloxane based surfactants are combined with a cosurfactant, particularly a nonionic cosurfactant, the wetting of the pretreater composition is improved because of greater penetration of the stained areas.

The siloxane based wetting agents have been used in agricultural sprays because of their characteristic spreading of the formulation over hydrophobic waxy leaf surfaces. Murphy, D., U.S. Ser. No. 08/039,868 filed Mar. 30, 1993 for a Super-spreading Low-foam Surfactant for Agricultural Spray Mixtures. In contrast, fabric surfaces are quite hydrophilic, especially cotton fabric, so that the penetration of a composition into the interfiber spaces of the fabric is a quite different function than the spreading of an agricultural pesticide over a two dimensional hydrophobic leaf surface.

Additionally, in the agricultural application the combination of a cosurfactant with the siloxane material, particularly a cosurfactant having a straight chained alkyl with 10 or more carbons or an alkyl phenol is known to negate the wetting effects of the siloxane surfactant and prevent penetration of the agricultural spray. The combination of cosurfactant with siloxane surfactant of the present invention was observed to synergistically improve the penetration of the pretreater composition into the soiled and stained areas of a variety of fabrics. This is surprising in view of the fact that many of the cosurfactants of the present invention are known to negate the spreading effect of this siloxane material in the agricultural application.

Without being limited to theory, it is postulated that the greater penetration from the synergistic effect of these two co-surfactants improves the delivery of the actives of the pretreater composition to the stained surface areas and therefore improves cleaning performance without the addition of chelating agents, solvents and builders.

Cosurfactants

The combination of a cosurfactant with the above described siloxane surfactant was found to synergistically improve the penetration of the pretreater composition and thus improve cleaning performance.

The cosurfactant may be either a nonionic, an anionic, a cationic, an amphoteric, a zwitteronic and mixtrues thereof. Preferably, a nonionic, an anionic or a nonionic/anionic mixture is incorporated in the invention. Most preferably a nonionic surfactant, particularly a polyoxyalkylene condensate or an alkyl glycosidet is used.

In the compositions of the present invention, the cosurfactant should be present in amounts ranging from about 0.01 to about 50% by weight preferably from about 0.5 to about 20%, most preferably between about 1 and 15%.

Nonionic Surfactants

The nonionic surfactants useful in the present invention as a co-surfactant with the siloxane based surfactant described above are those compounds produced by the condensation of alkylene oxide groups with an organic hydrophobic material which may be aliphatic or alkyl or aromatic in nature. The link of the hydrophilic or polyoxyalkylene radical which is condensed with any particular hydrophobic group can be readily adjusted to yield a water soluble compound having the desired degree of balance between hydrophilic and hydrophobic elements. Illustrative, but not limiting examples, of various suitable non-ionic surfactant types are:

(a) polyoxyethylene or polyoxypropylene condensates of aliphatic alcohols, whether linear- or branched-chain and unsaturated or saturated, containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol. Particularly preferred nonionic surfactant compounds in this category are the "Neodol" type products, a registered trademark of the Shell Chemical Company.

Also included within this category are nonionic surfactants having a formula:

$$R-(CH_2\underset{\underset{R^1}{|}}{C}HO)_x(CH_2CH_2)_y(CH_2\underset{\underset{R^2}{|}}{C}HO)_zH \quad \text{(II)}$$

wherein R is a linear alkyl hydrocarbon radical having an average of 6 to 18 carbon atoms, $R_1$ and $R^2$ are each linear alkyl hydrocarbons of about 1 to about 4 carbon atoms, x is an integer of from 1 to 6, y is an integer of from 4 to 20 and z is an integer from 4 to 25.

One preferred nonionic surfactant of formula I is PolyTergent SLF-18® a registered trademark of the Olin Corporation, New Haven, Conn. having a composition of the above formula where R is a $C_6$–$C_{10}$ linear alkyl mixture, $R^1$ and $R^2$ are methyl, x averages 3, y averages 12 and z averages 16. Also suitable are alkylated nonionics as are described in U.S. Pat. No. 4,877,544 (Gabriel et al.), incorporated herein by reference.

Another nonionic surfactant included within this category are compounds of formula:

$$R^3-(CH_2CH_2O)_aH \quad \text{(III)}$$

wherein $R^3$ is a $C_6$–$C_{24}$ linear or branched alkyl hydrocarbon radical and a is a number from 2 to 50; more preferably $R^3$ is a $C_8$–$C_{18}$ linear alkyl mixture and a is a number from 2 to 15.

(b) polyoxyethylene or polyoxypropylene condensates of aliphatic carboxylic acids, whether linear- or branched-chain and unsaturated or saturated, containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid, (c) polyoxyethylene or polyoxypropylene condensates of alkyl phenols, whether linear- or branched-chain and unsaturated or saturated,containing from about 6 to 12 carbon atoms and incorporating from about 2 to about 25 moles of ethylene oxide and/or propylene oxide.

(d) polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tripalmitate, sorbitan monostearate, sorbitan monoisostearate, sorbital tristearate, sorbitan monooleate, and sorbitan trioleate. The polyoxyethylene chains may contain between about 4 and 30 ethylene oxide units, preferably about 20. The sorbitan ester derivatives contain 1, 2 or 3 polyoxyethylene chains dependent upon whether they are mono-, di- or tri-acid esters.

(e) polyoxyethylene-polyoxypropylene block copolymers having formula:

$$HO(CH_2CH_2O)_a(CH(CH_3)CH_2O)_b(CH_2CH_2O)_cH \quad (IV)$$

or $$HO(CH(CH_3)CH_2O)_d(CH_2CH_2O)_e(CHCH_3CH_2O)_fH \quad (V)$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material preferably has a molecular weight of between about 1,000 and 15,000, more preferably from about 1,500 to about 6,000. These materials are well-known in the art. They are available under the trademark "Pluronic" and "Pluronic R", a product of BASF Corporation.

(f) eAlkyl glycosides having formula:

$$R^4O(R^5O)_n(Z^1)_p \quad (VI)$$

wherein $R^4$is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^5$ is a divalent hydrocarbon radical containing from 2 to about 4 carbon atoms such as ethylene, propylene or butylene (most preferably the unit $(R^5O)_n$ represents repeating units of ethylene oxide, propylene oxide and/or random or block combinations thereof); n is a number having an average value of from 0 to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5.

Examples of commercially available materials from Henkel Kommanditgesellschaft Aktien of Dusseldorf, Germany include APG® 300, 325 and 350 with $R^4$ being $C_9$–$C_{11}$, n is 0 and p is 1.3, 1.6 and 1.8–2.2 respectively; APG® 500 and 550 with $R^4$ is $C_{12}$–$C_{14}$,n is n is 0 and p is 1.3 and 1.8–2.2, respectively; and APG® 600 with $R^4$ being $C_{12}$–$C_{14}$, n is 0 and p is 1.3. Particularly preferred is APG® 600.

The nonionic surfactant which are most preferred are the polyoxyalkylene condensates of paragraphs "(a)" and "(b)" and the alkyl glycosides. Most preferred are the polyoxyalkylene condensates.

Anionic Surfactants

Examples of the anionic synthetic materials are salts (including sodium, potassium, ammonium and substituted ammonium salts) such as mono-, di- and triethanolamine salts of 9 to 20 carbon alkylbenzenesulphonates, 8 to 22 carbon primary or secondary alkanesulphonates, 8 to 24 carbon olefinsulphonates sulphonated polycarboxylic acids prepared by sulphonation of pyrolized product of alkaline earth metal citrates, e.g., as described in British Patent specification, 1,082,179, 8 to 22 carbon alkylsulphates, 8 to 24 carbon alkylpoly-glycol-ether-sulphates, -carboxylates and -phosphates (containing up to 10 moles of ethylene oxide); further examples are described in "Surface Active Agents and Detergents" (vol I and II) by Schwartz, Ferry and Bergh. Any suitable anionic may be used and the examples are not intended to be limiting in any way.

Cationic Surfactants

Examples of cationic detergents which may be used are any one of the commercially available quaternary ammonium compounds such as alkyldimethylammonium halogenides.

Amphoteric or Zwitterionic Surfactants

Examples of amphoteric or zwiterionic surfactants which may be used in the invention are N-alkamine acids, sulphobetaines, condensation products of fatty acids with protein hydrolysates; but owing to their relatively high costs they are usually used in combination with an anionic or a nonionic surfactants. Mixtures of the various types of active surfactants may also be used, and preference is given to mixtures of an anionic and a nonionic active. Soaps (in the form of their sodium, potassium and substituted ammonium salts) of fatty acids may also be used, preferably in conjunction with an anionic and/or nonionic synthetic material.

Antiredeposition Polymers

Antiredeposition Polymers are preferably incorporated in the formulations of the invention. Such polymers include polycarboxylates (e.g. copolymers of acrylate/maleate commercially available as Sokolan® copolymers supplied by BASF, and acrylate/laurylmethacrylate supplied as Narlexl®DCI copolymers by National Starch and Chemical Co.); polyoxyalkylene copolymers (e.g. Pluronic Series supplied by BASF); carboxymethylcelluloses (e.g. CMC Series supplied by Union Carbide); methylcellulose (e.g. Methocel from Dow Chemical) and ethoxylated polyamines (e.g. ethoxylated tetra ethylene pentamine from Shell Chemical Co).

Especially preferred are the polycarboxylate polymers. The polymers should be incorporated in the formulations of the invention in an amount of up to about 5 wt. %, preferably 0.1 wt. % to 3 wt. %, most preferably 0.5 wt. % to 1 wt. %.

Enzymes

Enzymes may optionally be included in the pretreater formulation to enhance the removal of soils from fabrics. If present, the enzymes are in an amount of from about 0 to 10 weight %, preferably 1 to about 5 wt. %. Such enzymes include proteases (e.g. Alcalase®, Savinase® and Esperase® from Novo Industries A/S), amylases (e.g. Termamyl®0 from Novo Industries A/S), lipolases (e.g. Lipolase® from Novo Industries A/S) and cellulases, (e.g. Celluzyme® from Novo Industries A/S).

Enzyme Stabilizing System

Stabilizers or stabilizer systems may be used in conjunction with enzymes and generally comprise from about 1 to 15% by weight of the composition.

The enzyme stabilization system may comprise calcium ion; boric acid, propylene glycol and/or short chain carboxylic acids. The composition preferably contains from about 0.01 to about 50, preferably from about 0.1 to about 30, more preferably from about 1 to about 20 millimoles of calcium ion per liter.

When calcium ion is used, the level of calcium ion should be selected so that there is always some minimum level available for the enzyme after allowing for complexation with builders, etc., in the composition. Any water-soluble calcium salt can be used as the source of calcium ion, including calcium chloride, calcium formate, calcium acetate and calcium propionate.

A small amount of calcium ion, generally from about 0.05 to about 2.5 millimoles per liter, is often also present in the composition due to calcium in the enzyme slurry and formula water.

Another enzyme stabilizer which may be used is prcpionic acid or a propionic acid salt capable of forming propionic acid. When used, this stabilizer may be used in an amount from about 0.1% to about 15% by weight of the composition.

Another preferred enzyme stabilizer is polyols containing only carbon, hydrogen and oxygen atoms. They preferably contain from 2 to 6 carbon atoms and from 2 to 6 hydroxy groups. Examples include propylene glycol (especially 1,2 propanediol which is preferred), ethylene glycol, glycerol, sorbitol, mannitol and glucose. The polyol generally represents from about 0.5% to about 15%, preferably from about 1.0% to about 8% by weight of the composition.

The composition herein may also optionally contain from about 0.25% to about 5%, most preferably from about 0.5% to about 3% by weight of boric acid. The boric acid may be, but is preferably not, formed by a compound capable of forming boric acid in the composition. Boric acid is preferred, although other compounds such as boric oxide, borax and other alkali metal borates (e.g. sodium ortho-, meta- and pyroborate and sodium pentaborate) are suitable. Substituted boric acids (e.g., phenylboronic acid, butane boronic acid and a p-bromo phenylboronic acid) can also be used in place of boric acid.

One especially preferred stabilization system is a polyol in combination with boric acid. Preferably, the weight ratio of polyol to boric acid added is at least 1, more preferably at least about 1.3.

Polymeric Thickeners

Salts of polyacrylic acid having a molecular weight of from about 300,000 up to about 6 million, including polymers which are cross-linked, are useful in the invention, especially for the formulation of gel or stick forms. Acrylic acid polymers that are cross-linked and are manufactured by, for example, B.F. Goodrich and sold under the trademark "Carbopol" have been found useful. Especially effective are Carbopol® 940 and 617 having a molecular weight of about 4 million.

Preparation of Formulations

The formulations of the invention may be prepared in any form known in the art such as liquid, spray and semi-solid stick form. The compositions should be prepared by conventional formulation methods such as those described in U.S. Pat. No. 4,842,762, particularly directed to a stick form and U.S. Pat. No. 5,186,856, particularly directed to an aqueous form, herein incorporated by reference.

In general, aqueous formulations are prepared by mixing the nonionic and siloxane based surfactants together and heat the mixture to a temperature of up to 160° F. The mixture is then cooled and the enzymes and enzyme stabilizing system may be added. Optional ingredients, such as preservatives, dyes and perfumes are added to the cooled mixtures. The compositions are then packaged and stored.

The gel and stick forms are processed by adding fatty acids and polyols such as sorbitol, glycerol, and propylene glycol to the heated nonionic and siloxane based surfactant mixtures to form a homogeneous batch. Once the batch is cooled to less than about 50° C., the enzyme and enzyme stabilizing systems may be added. Optional ingredients, such as preservatives, dyes and perfumes are added to the cooled mixtures. The formulations are packaged and stored.

Heavy Duty Liquid Formulations

The siloxane based surfactant may also be incorporated into a heavy duty liquid formulation to be used both as a pretreater and a laundry washing detergent. In such cases, the compositions would comprise a detergent active. The detergent active material may be an alkaline metal or alkanolamine soap or a 10 to 24 carbon atom fatty acid, including polymerized fatty acids in addition to the surfactant materials, (i.e. anionic, nonionic, cationic, zwiteronic or amphoteric synthetic material and mixtures of these.

Detergency Builders

Builders which can be used according to this invention include conventional alkaline detergency builders, inorganic or organic, which can be used at levels from 0% to about 50% by weight of the composition, preferably from 1% to about 20% by weight, most preferably from 2% to about 8%.

Examples of suitable inorganic alkaline detergency builders are water-soluble alkalimetal phosphates, polyphosphates, borates, silicates and also carbonates. Specific examples of such salts are sodium and potassium triphosphates, pyrophosphates, sorthophosphates, hexametaphosphates, tetraborates, silicates and carbonates.

Examples of suitable organic alkaline detergency builder salts are: (1) water-soluble amino polycarboxylates, e.g., sodium and potassium ethylenediaminetetraacetates, nitrilotriacetates and N-(2 hydroxyethyl)-mitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium slats of methylene diphosphhonic acid, and sodium potassium and lithium salts of ethane-1,1-2triphosphonic acid. Other examples include the alkali methyl salts of ethane-2-carboxy- 1,1,2-triphosphonic acid hydroxymethanediphosphonic acid, carboxylid iphosphonic acid, ethane-1-hydroxy- 1,1,2-triphosphonic acid, ethane-2-hydroxy-1,1,2-triphosphonic acid, propane-1,1,3,3-tetraphosphonic acid, propane-1,1-2,3-tetraphosphonic acid, and propane-1,2,2,3-tetraphosphonic acid; (4) water soluble salts of polycarboxylate polymers and copolymers as described in U.S. Pat. No. 3,308,067.

In addition, polycarboxylate builders can be used satisfactorily, including water-soluble salts of myelitic acid, citric acid, and carboxymethyloxysuccinic acid and salts of polymers of itaconic acid and maleic acid. Other polycarboxylate builders include DPA (dipicolinic acid) and ODS (oxydisuccinic acid). Certain zeolites or aluminosilicates can be used. One such aluminosilicate which is useful in the compositions of the invention is an amorphous water-insoluble hydrated compound of the formula $Na_x(A1O_2-SiO_2)$, wherein x is a number from 1.0 to 1.2 and y is 1, said amorphous material being further characterized by a Mg++ exchange capacity of from about 50 mg. eq. $CaCO_3$/g. and a particle diameter of from about 0.01 micron to about 5 microns. This ion exchange builder is more fully described in British Pat. No. 1,470,250.

Optional Ingredients

One or more optional additives may be included in the formulations including perfumes, dyes, pigment, opacifiers, germicides, optical brighteners, anticorrosional agents and preservatives. Each preservative incorporated in the composition should be present in an amount of up to about 0.5% by wt.

The following examples will serve to distinguish this invention from the prior art and illustrate its embodiments more fully. Unless otherwise indicated, all parts, percentages and proportions referred to are by weights.

EXAMPLE I

An aqueous formulation according to the invention was prepared as Sample A below. As a comparison, an aqueous pretreater formulation without the siloxane surfactant was prepared as Sample B.

TABLE 1

| Ingredient | Samples A | Samples B |
|---|---|---|
| borax pentahydrate | 2 | 2 |
| glycerol | 3 | 3 |
| alcohol ethoxylate[1] | 14 | 15 |
| siloxane surfactant[2] | 1 | 0 |
| protease 16L | 0.69 | 0.69 |
| lipolase 100L | 1.2 | 1.2 |
| amylase L30 | 1.38 | 1.38 |
| thixotropic polymer[3] | 0.5 | 0 |
| preservative | .003 | .003 |
| deionized water | to 100% | |

[1]a nonionic surfactant having 12–15 carbon atoms in the hydrophobic group and 9 EOs and supplied as Neodol 25-9 by Shell Chemical Co.
[2]a siloxane of formula I wherein $R_1$ is $—C_nH_{2n}O[C_2H_4O]_y—[C_3H_6O]_z—Q$ $R_2$ is methyl, a is 1, n is 3, y is 8, z is 0 and Q is methyl and supplied as Silwet ® L-77 surfactant by OSi Specialties Inc.
[3]an acrylate/laurylmethacrylate copolymer supplied as Narlex ® DC1 by National Starch and Chemical Co.

The liquid composition of the invention was made by charging a vessel with water and heating to 160° F., adding the borax and stirring the liquid until a clear solution was obtained. The surfactants were then added, and the heater turned off. The siloxane surfactant and antiredeposition polymer were added when the solution temperature was between 120–150° F. The enzymes were added when the solution temperature was below 120° F., then preservative was added. The pH of the formulation was then adjusted to 7.0 (±0.5).

EXAMPLE II

The cleaning performance of the inventive composition (Sample A) versus Sample B without a siloxane surfactant was evaluated on ten different stains and on three types of fabric as follows.

The three types of test cloths used to evaluate the compositions were:

1) 100% cotton
2) 50%/50% polyester/cotton blend
3) double knit 100% polyester

Cloths 1 and 2 were obtained from Textile Innovations (Windsor, N.C.), and the polyester cloth 3 was obtained from Test Fabrics (Middlesex, N.J.). Prior to staining the cloths were prewashed 5 times in Dye Free Liquid "all" at 130° F. (and dried) to remove spinning oils and increase the absorbency of the cloth. For liquid pretreaters, swatches were cut to 4¾"×8¾", and a 2" diameter circle inscribed in the middle.

10 different stains were used as follows:

1) Grass (100 g grass clippings added to 200 g water, blended, filtered through cotton ballast, 100 g more clippings and 200 g more water added to filtrate,and new mixture filtered).
2) Cow's blood
3) Spinach
4) Olive oil
5) Spaghetti sauce (strained once)
6) Dirty motor oil
7) Liquid foundation make-up
8) Coffee
9) Grape juice
10) Mud (strained dirt mixed 1:1 with water and blended)

The stains were applied over the 2" circle on each swatch as outlined in Table 2:

TABLE 2

| Stain | Dosage Cotton | Dosage Blend | Dosage Polyester | Treatment |
|---|---|---|---|---|
| grass | 8 drops (2×) | 8 drops (2×) | ¼ tsp. | overnight |
| blood | 7 drops | 7 drops | 18 drops | overnight |
| spinach | ⅛ tsp (2×) | ⅛ tsp (2×) | ¼ tsp (2×) | overnight |
| olive oil | ⅛ tsp | ⅛ tsp | ¼ tsp | overnight |
| spaghetti sauce | 0.5 g | 0.45 g | ¼ tsp | overnight |
| dirty motor oil | 10 drops | 10 drops | ¼ tsp | 1 hour |
| make-up | 7 drops | 6 drops | 28 drops | overnight |
| coffee | ⅛ tsp (2×) | ⅛ tsp (2×) | ¼ tsp (2×) | overnight |
| grape juice | 9 drops | 9 drops | 20 drops | overnight |
| mud | ⅛ tsp | ⅛ tsp | ¼ tsp | overnight |

Stained clothes were treated for 5 minutes with 2.0 g of liquid pretreater and washed in 17 gallons of 95° F. tap water with 121.37 g of Arm & Hammer Liquid laundry detergent followed by a cold rinse. The cloths were then placed in a static dryer until dry. Four replicates of each stain with each cloth were performed.

Stain removal was measured by reflectometry and color change using a Pacific Scientific Colorgard System model 5 calorimeter. The stain removal index (SRI) gives a numerical value for stain removal and is defined as:

$$SRI=100-[(L_c-L_w)^2+(a_c-a_w)^2+(b_c-b_w)^2]^{1/2}$$

Where:

L=measured lightness (reflectance) value a=measured greenness/redness value b=measured blueness/yellowness value c=clean cloth w=stained and washed cloth Results were reported as rank sums. For a given stain on a given fabric, the pretreater with the highest SRI is given a value of 1, second highest 2, third highest 3, and so on. The rankings are then summed over all the stains for a given fabric. The lower the rank sum for a product, the more cleaning benefit it is achieving.

Stain removal data for Samples A and B for the ten stains on the three types of cloth were observed are reported in Table 3 below:

TABLE 3

| Sample | Cloths Cotton | Cloths Blend | Cloths Polyester | Total |
|---|---|---|---|---|
| A | 12 | 11 | 14 | 37 |
| B | 22 | 22 | 20 | 64 |
| No pretreater composition | 26 | 27 | 26 | 79 |

It was thus observed that the inventive Sample A was significantly more effective at stain removal than the condition not containing the trisiloxane surfactant. In fact, the Sample B composition did not appear significantly more effective than cloths having no pretreating.

EXAMPLE III

A composition (Sample C) was prepared as described in Example I except the antiredeposition polymer used was supplied as Sokalan® polymer by BASF. The cleaning performance of Sample C was compared to three commercially available pretreating compositions having the following formulas:

TABLE 4

| Ingredient | Commercial Product 1 | Commercial Product 2 | Commercial Product 3 |
|---|---|---|---|
| nonylphenol ethoxylate | 12 | 8 | — |
| Alkyl ethoxylate (5EO) | — | — | 9.3 |
| Sodium alkyl benzene-sulfonate | — | — | 3.7 |
| sodium xylene sulfonate | — | — | 6.1 |
| sodium citrate | — | 1.8 | — |
| protease | 0.7 | — | — |
| water | | to 100% | |

The following six stains were applied to cotton, polyester and polyester blend as described in Example 2 above, grass, blood, spinach, spaghetti sauce, coffee and mud. Stain removal was observed for the inventive composition in comparison to the three commercially available compositions. As a control, stain removal was observed on washed cloths which were not pretreated. The following results were observed:

TABLE 5

| Sample | Cotton | Blend | Polyester | Total |
|---|---|---|---|---|
| Sample C | 6 | 12 | 10 | 28 |
| Commercial Product 1 | 16 | 12 | 16 | 44 |
| Commercial Product 2 | 19 | 17 | 15 | 51 |
| Commercial Product 3 | 21 | 20 | 19 | 60 |
| No Pretreat | 28 | 29 | 30 | 87 |

From the results described in Table 5, it was observed that the inventive formulation was superior for all six stains on cotton, and significantly better for these stains on blends and polyester, in stain removal to the three commercially available formulations.

EXAMPLE IV

To observe the synergistic effect of the siloxane based surfactant and a nonionic surfactant, alkyl ethoxylate, the commercial product #2 was modified by incorporating 1% of the siloxane compound as described in Example III above. The modified commercial product was tested for stain removal on cotton, polyester and polyester/cotton blend for the six stains described in Example II above. It was observed that the commercial product was statistically improved in removing spinach and grape juice from cotton and on removing dirty motor oil, coffee and grape juice on the polyester/cotton blend. The combination of the siloxane based surfactant in the commercial product #2 significantly increased stain removal.

EXAMPLE V

A gel form of the inventive formulation is as follows:

| Ingredient | % Active |
|---|---|
| Nonionic surfactant[1] | 31.0 |
| Glycerol | 6 |
| NaOH | 0.2 |
| Coconut fatty acid | 1.4 |
| Stearic acid | 0.5 |

-continued

| Ingredient | % Active |
|---|---|
| Siloxane surfactant[2] | 1.0 |
| Polymer[3] | 0.5 |
| Enzyme 16L | 1.0 |
| Preservative | 0.003 |
| Deionized water | to 100% |

[1]supplied as Neodol 25-7 (20.7%) and Neodol 25-3 (10.3%) by Shell Co.
[2]as described in Example I.
[3]acrylate/maleate copolymer supplied as Sokalan CP5 by BASF.

The gel formulation is made by charging a vessel with water and heating it up to 160° F. The nonionics are then added with the nonionic having the highest HLB value added first. The glycerol, sodium hydroxide, stearic acid, coconut fatty acid, siloxane based surfactant, polymer, enzyme and preservative are added to the heated mixture. The formulation is then cooled and stored.

EXAMPLE VI

A stick form of the preventive pretreater composition is prepared by processing the following ingredients.

| Ingredient | % Active |
|---|---|
| Nonionic surfactant[1] | 57% |
| Siloxane based surfactant[2] | 1% |
| Propylene glycol | 13% |
| Coconut fatty acid | 15% |
| Acrylate/maleate copolymer[3] | 2% |
| Deionized water | 6% |
| Sodium hydroxide (50%) | 5% |
| Proteolytic enzyme (100L) | 1% |

[1]supplied as Neodol 25-7 by Shell Company.
[2]as described in Example I.
[3]supplied as Sokalan CP5 by BASF.

The nonionic surfactant, the siloxane based surfactant and the propylene glycol are added together in a mixture with low to medium agitation. The batch is heated up 40° C. The fatty acid is then added and heating is continued until the batch reaches 55° C. Once the fatty acid has completely melted, the copolymer and water is added with heating to maintain the batch at 50–55° C. Once the batch is homogeneous, the sodium hydroxide is added. The batch is then mixed for 45 minutes to ensure full neutralization of the fatty acid. The batch is then cooled to 50° C. The enzyme is added and mixed until the mixture is homogeneous. The batch is then placed in a package and allowed to air cool with or without chilling.

EXAMPLE VII

An aqueous formulation containing a mixture of an anionic and a nonionic cosurfactant is prepared as described in Example I and has the following formula:

| Ingredient | % Active |
|---|---|
| sodium alkylbenzene sulfonate | 12 |
| alcohol ethoxylate | 3 |
| trisiloxane surfactant | 1 |
| protease | 1 |
| borax pentahydrate | 2 |

-continued

| Ingredient | % Active |
|---|---|
| giycerol | 3 |
| Narlex DC-1 | 1 |
| Kathon | 0.003 |
| water | to 100 |

EXAMPLE VIII

An aqueous formulation containing a mixture of an amphoteric and a nonionic cosurfactant is prepared as described in Example 1 and has the following formula:

| Ingredient | % active |
|---|---|
| cocamidopropyl sulfobetaine[1] | 12 |
| alcohol ethoxylate | 3 |
| trisiloxane surfactant | 1 |
| protease | 1 |
| borax pentahydrate | 2 |
| glycerol | 3 |
| Sokalan CP-5 | 1 |
| Kathon | 0.003 |
| water | to 100 |

[1]Available as Rewoteric AM CAS from Sherex Chemical Co.

EXAMPLE IX

A heavy duty liquid detergent formulation according to the invention is as follows:

| Ingredient | % Active |
|---|---|
| Siloxane based surfactant[1] | 1 |
| Sodium alkyl benzemesulfonate | 8.0 |
| Sodium alcohol ethoxy sulfate | 14.0 |
| Alcohol ethoxyiate | 9.0 |
| Sodium citrate | 5.0 |
| Borax | 3.0 |
| Propylene glycol | 4.0 |
| Enzymes | 1.05 |
| Glycerol | 2.7 |
| Sorbitol | 4.5 |
| Water | to 100 |

[1]as described in Example I.

The Ingredients, except for the enzyme and enzyme stabilizing system, are combined with heating until a homogeneous mixture is formed at about 40° C. The mixture is then cooled and the enzymes and enzyme stabilizing system added until a homogeneous mixture is again obtained. The batch is placed in a package and allowed to air cool with or without cooling.

We claim:

1. An aqueous laundry prewash stain remover composition consisting of:

a) 0.1 to about 10 wt. % of a siloxane based surfactant having a formula I:

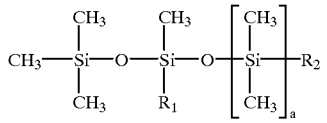

wherein $R_1$ and $R_2$ are each independently an alkyl having 1–3 carbons or $C_nH_{2n}[OC_2H_4][C_3H_6O]_z$—Q provided $R_1$ and $R_2$ are not the same, a is 0–2, n has a value from 2 to 4; y has a value of 3 to 10; z has a value from 0 to 5; Q is selected from the group consisting of hydrogen and a branched or straight chain alkyl having 1 to 4 carbon atoms;

b) about 0.1 to about 50% of a cosurfactant selected from the group consisting of a nonionic, an anionic, a cationic, a zwitteronic and mixtures thereof;

c) 0 to about 5 wt. % of an antiredeposition polymer; and d) 0 to 10 wt. % of an enzyme.

2. The composition according to claim 1 wherein the siloxane surfactant is a compound wherein a is 0 to 1, n is 2 to 4, y is 5 to 9, z is 0 to 3 and Q is a 1 to 3 straight chain alkyl.

3. The composition according to claim 1 wherein the siloxane surfactant is selected from the group consisting of polyalkylene oxide modified 1, 1, 1, 3, 5, 5, 5-heptamethyl, trisiloxane, polyalkylene oxide modified 1,1,3,3,5,5,5-heptamethyl trisiloxane, and polyalklyene oxide modified 1, 1, 3, 3, 3 pentamethyl disiloxane.

4. The composition according to claim 1 wherein the surfactant is a nonionic surfactant selected from the group of a polyoxyalkylene condensate of an aliphatic alcohol, the polyoxyalkylene condensate of an aliphatic carboxylic acid and mixtures thereof.

5. The composition according to claim 4 wherein the polyalkylene condensation has from about 6 to about 24 carbon atoms in the aliphatic chain and incorporates about 2 to about 50 alkylene oxide groups.

6. The composition according to claim 1 wherein the antiredeposition polymer is a polycarboxylate.

7. The composition according to claim 6 wherein the polymer is present in an amount of from about 0.5 to about 3 wt. %.

8. The composition according to claim 1 wherein the enzyme is selected from the group consisting of a protease, an amylase, a lipase, a cellulase and mixtures thereof.

9. A method of pretreating stained fabrics with a stain remover composition consisting of the steps of:

applying a stain remover composition to a stained fabric, the composition comprising:

a) 0.1 to about 10 wt. % of a siloxane based surfactant being a formula I:

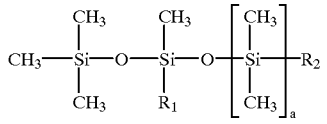

wherein $R_1$ and $R_2$ are each independently an alkyl having 1–3 carbons or $C_nH_{2n}O[C_2H_4O][C_3H_6O]_z$—Q provided $R_1$ and $R_2$ are not the same, a is 0–2, n has a value from about 2 to 4; y has a value of 3 to 10; z has a value from about 0 to 5; Q is selected from the group consisting of hydrogen and a branched or straight chain alkyl having 1 to 4 carbon atoms;

b) from about 0.1 to about 50% of a cosurfactant selected from the group consisting of a nonionic, an anionic, a cationic, a zwitterionic and mixtures thereof;

c) 0 to about 5 wt. % of an antiredeposition polymer; and d) 0 to 10 wt. % of an enzyme.

10. The method according to claim 9 wherein the siloxane surfactant is a compound wherein a is 0 to 1, n is 2 to 4, y is 5 to 9, z is 0 to 3 and Q is a 1 to 3 straight chain alkyl.

11. The method according to claim 10 wherein the siloxane surfactant is selected from the group consisting of polyalkylene oxide modified 1, 1, 1, 3, 5, 5, 5-heptamethyl, trisiloxane, polyalkylene oxide modified 1,1,3,3,5,5,5-heptamethyl trisiloxane, and polyalklyene oxide modified 1, 1, 3, 3, 3 pentamethyl disiloxane.

12. The method according to claim 9 wherein the surfactant is a nonionic surfactant selected from the group of a polyoxyalkylene condensate of an aliphatic alcohol, the polyoxyalkylene condensate of an aliphatic carboxylic acid and mixtures thereof.

* * * * *

UNITED STATES PATENT AND TRADEMARK OFFICE

CERTIFICATE OF CORRECTION

PATENT NO. : 6,077,317

DATED : June 20, 2000

INVENTOR(S) : Murphy

It is certified that error appears in the above-identified patent and that said Letters Patent is hereby corrected as shown below:

Column 14, claim 1, line 9 wherein: "$C_nH_{2n}[OC_2H_4][C_3H_6O]_z$—Q"

should have read: – $C_nH_{2n}[OC_2H_4]_y[C_3H_6O]_z$—Q –

Column 14, claim 9, line 61 wherein: "$C_nH_{2n}[OC_2H_4][C_3H_6O]_z$—Q"

should have read: — $C_nH_{2n}[OC_2H_4]_y[C_3H_6O]_z$—Q —

Signed and Sealed this

Eighth Day of May, 2001

*Attest:*

Nicholas P. Godici

NICHOLAS P. GODICI

*Attesting Officer*

*Acting Director of the United States Patent and Trademark Office*